US010004268B2

(12) United States Patent
Liu

(10) Patent No.: US 10,004,268 B2
(45) Date of Patent: Jun. 26, 2018

(54) ELECTRONIC CIGARETTE

(71) Applicant: KIMREE HI-TECH INC., Road Town, Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days. days.

(21) Appl. No.: 15/318,802

(22) PCT Filed: Jun. 16, 2014

(86) PCT No.: PCT/CN2014/079968
§ 371 (c)(1),
(2) Date: Dec. 14, 2016

(87) PCT Pub. No.: WO2015/192303
PCT Pub. Date: Dec. 23, 2015

(65) Prior Publication Data

US 2017/0119057 A1 May 4, 2017

(51) Int. Cl.
*A24F 47/00* (2006.01)
*H05B 1/02* (2006.01)
(Continued)

(52) U.S. Cl.
CPC ..... *A24F 47/008* (2013.01); *F21V 7/0091* (2013.01); *F21V 19/004* (2013.01);
(Continued)

(58) Field of Classification Search
CPC .. A24F 47/008; A61M 11/042; A61M 11/044; A61M 15/06
See application file for complete search history.

(56) References Cited

U.S. PATENT DOCUMENTS

2008/0257367 A1* 10/2008 Paterno ..... A24F 47/008 131/328
2010/0200008 A1 8/2010 Taieb
(Continued)

FOREIGN PATENT DOCUMENTS

| | | | |
|---|---|---|---|
| CN | 101518361 | A | 9/2009 |
| CN | 103271447 | A | 9/2013 |
| WO | 2013040193 | A2 | 3/2013 |

OTHER PUBLICATIONS

State Intellectual Property Office of the P.R. China (ISR/CN), "International Search Report for PCT/CN2014/079968", China, dated Sep. 28, 2014.

*Primary Examiner* — Tulsidas C Patel
*Assistant Examiner* — Marcus Harcum
(74) *Attorney, Agent, or Firm* — Tim Tingkang Xia, Esq.; Locke Lord LLP

(57) ABSTRACT

An electronic cigarette is provided, comprising a electronic cigarette body, wherein, the electronic cigarette body includes a atomization assembly configured for atomizing tobacco tar, a battery assembly configured for supplying power to the atomization assembly, an airflow sensing assembly configured for sensing a smoking action, and a control module configured for controlling the battery assembly to supply power to the atomization assembly based on a smoking signal sent by the airflow sensing assembly; a receiving space is formed between the atomization assembly and the battery assembly; a lamp assembly electrically connected to the battery assembly is received in the receiving space; a light transmission portion is provided on a side wall of the electronic cigarette body that corresponds to the receiving space, and is configured to transmit lights emitted from the lamp assembly to the outside of the electronic cigarette body.

12 Claims, 5 Drawing Sheets

(51) Int. Cl.

| | |
|---|---|
| ***F21V 7/00*** | (2006.01) |
| ***F21V 33/00*** | (2006.01) |
| ***F21V 19/00*** | (2006.01) |
| *F21W 111/10* | (2006.01) |
| *F21Y 115/10* | (2016.01) |

(52) U.S. Cl.
CPC ..... *F21V 33/0004* (2013.01); *H05B 1/0244* (2013.01); *F21W 2111/10* (2013.01); *F21Y 2115/10* (2016.08); *H05B 2203/021* (2013.01)

(56) References Cited

U.S. PATENT DOCUMENTS

| | | | | |
|---|---|---|---|---|
| 2011/0011396 | A1* | 1/2011 | Fang | A24F 47/008 128/202.21 |
| 2012/0048266 | A1* | 3/2012 | Alelov | A61M 11/005 128/202.21 |
| 2014/0083442 | A1 | 3/2014 | Scatterday | |
| 2014/0116455 | A1* | 5/2014 | Youn | A24F 47/008 131/329 |
| 2014/0261489 | A1* | 9/2014 | Cadieux | A24F 47/008 131/328 |
| 2014/0334804 | A1* | 11/2014 | Choi | A61M 15/06 392/404 |
| 2014/0366898 | A1* | 12/2014 | Monsees | A24F 47/008 131/329 |
| 2015/0059784 | A1* | 3/2015 | Liu | A24F 47/008 131/329 |
| 2015/0196057 | A1* | 7/2015 | Wu | A24F 47/008 131/329 |
| 2015/0359263 | A1* | 12/2015 | Bellinger | A24F 47/008 392/394 |

* cited by examiner

ELECTRONIC CIGARETTE

TECHNICAL FIELD

The present application relates to the field of daily electronic products, and more specifically, relates to an electronic cigarette.

BACKGROUND

An electronic cigarette comprises an atomization assembly configured to atomize tobacco tar and a battery assembly configured to supply power to the atomization assembly. Usually, a user may grip at a junction between the atomization assembly and the battery assembly or a special region of the atomization assembly, when gripping the electronic cigarette. In this way, the heat will transfer to the housing of the electronic cigarette after a heating wire in the region of the assembly is heated, and thus the region of the housing is hot. If the user grips the special region of the atomization assembly with his or her fingers, he or she will feel uncomfortable, and the fingers may even be scalded. In addition, for a conventional electronic cigarette, a key switch is usually provided at the junction between the atomization assembly and the battery assembly, and is configured to control the battery assembly to supply power to the atomization assembly. A relative great gap is formed between the key switch and the housing, so that external air can easily enter the atomization assembly through the gap, and the tobacco tar in the atomization assembly may be oxidized by the external air. Moreover, the tobacco tar in a conventional atomization assembly will be easily leaked out to the battery assembly by means of capillarity or gravity, which makes the circuits in the battery assembly short out because of the tobacco tar leaked out. Besides, the tobacco tar leaked may be oxidized, and thus peculiar smell will be produced. In this way, when the user is smoking, air with peculiar smell may be sucked in.

Therefore, the existing technology has drawbacks and needs to be improved.

SUMMARY

To solve the drawbacks in prior art, an improved electronic cigarette is provided in the present application.

The technical solutions to solve the technical problem are as follows: In one aspect, an electronic cigarette is provided, comprising a electronic cigarette body, wherein, the electronic cigarette body includes a atomization assembly configured for atomizing tobacco tar, a battery assembly configured for supplying power to the atomization assembly, an airflow sensing assembly configured for sensing a smoking action, and a control module configured for controlling the battery assembly to supply power to the atomization assembly based on a smoking signal sent by the airflow sensing assembly;

a receiving space is formed between the atomization assembly and the battery assembly; wherein the receiving space and an outer peripheral face of the electronic cigarette body that corresponds to the receiving space are isolated from each other, in such a way that air in the receiving space is isolated from air outside the outer peripheral face of the electronic cigarette body that corresponds to the receiving space; a lamp assembly is received in the receiving space; wherein the lamp assembly is electrically connected to the battery assembly and configured to emit light when the electronic cigarette is at work; a light transmission portion is provided on a side wall of the electronic cigarette body that corresponds to the receiving space, and is configured to transmit lights emitted from the lamp assembly to the outside of the electronic cigarette body;

an inlet channel configured for airflow to flow in and a smoke channel configured for smoke produced by the atomization assembly to flow out are defined in the electronic cigarette body; the receiving space is communicated with the inlet channel and the smoke channel respectively, in such a way that an airflow outside the electronic cigarette is capable of entering the inlet channel, and further entering the smoke channel after passing through the receiving space.

In one embodiment, the light transmission portion is in form of a circle, a triangle or a square.

In one embodiment, the electronic cigarette body further includes an atomization base; the atomization assembly includes a fixing pipe fixed on the atomization base, a tobacco tar storing element coated on the fixing pipe and configured for storing the tobacco tar, and a heating wire assembly configured for atomizing the tobacco tar; wherein the smoke channel is formed in the fixing pipe; the heating wire assembly is received in the smoke channel and is fixed on the fixing pipe.

In one embodiment, at least one end of the atomization assembly is received in the receiving space and corresponds to the light transmission portion; the atomization base is an elastic light guide element, and is configured to guide the light emitted from the lamp assembly to the light transmission portion.

In one embodiment, the lamp assembly includes a lamp body, a circuit board and a bracket; the bracket is in form of a cylinder, and is connected to an inner wall of the external sleeve by an interference fit; one end of the bracket abuts against one end of the atomization base; the circuit board is perpendicular to the axial direction of the atomization base, and is engaged with the bracket; the lamp body is mounted on one surface of the circuit board that is facing towards the atomization base.

Preferably, the lamp body is a LED light.

In one embodiment, a marker layer is provided on the outer surface of the electronic cigarette body that corresponds to the light transmission portion.

In this embodiment, the electronic cigarette body further includes an external sleeve; the atomization assembly, the battery assembly and the lamp assembly are all received in the external sleeve; the light transmission portion is provided on a region of the external sleeve that corresponds to the light transmission portion.

In this embodiment, the electronic cigarette further comprises a smoking end communicated with the smoke channel; the smoking end is connected to one end of the external sleeve that is far away from the battery assembly; the airflow sensing assembly is provided at one end of an inner side of the external sleeve that is far away from the atomization assembly; the airflow sensing assembly is communicated with the inlet channel.

Preferably, the external sleeve is a light transmission element.

Preferably, the light transmission portion is a light transmission hole defined on the region of the external sleeve that corresponds to the light transmission portion.

Preferably, the electronic cigarette body further includes a tag coated on an outer side wall of the external sleeve; the marker layer is provided on a region of the tag that corresponds to the marker layer.

Preferably, a coating layer is coated on an outer side wall of the external sleeve, and the marker layer is provided on a region of the coating layer of the external sleeve that corresponds to the light transmission portion.

In another embodiment, the external sleeve includes an atomization sleeve and a battery sleeve which are detachably connected to each other; the battery assembly is received in the battery sleeve, the atomization assembly is received in the atomization sleeve; a first electrode connecting element is provided at one end of the atomization sleeve that is close to the battery sleeve; a second electrode connecting element is provided at one end of the battery sleeve that is close to the atomization sleeve; wherein the first electrode connecting element is electrically is electrically connected to the atomization assembly, and the second electrode connecting element is electrically connected to the battery assembly;

the first electrode connecting element and the second electrode connecting element are detachably and electrically connected to each other; a first through hole is defined in the first electrode connecting element along an axial direction of the first electrode connecting element; wherein the first through hole is communicated with the receiving space; a second through hole is defined in the second electrode connecting element along an axial direction of the second internal electrode, wherein the second through hole is communicated with one end of the smoke channel that is far away from the smoking end; the first through hole is communicated with the second through hole.

Preferably, the battery assembly includes a battery; the receiving space is formed in the battery sleeve, and is located between the battery and the second electrode connecting element.

In another embodiment, the lamp assembly includes a lamp body, a circuit board and a bracket; the bracket is substantially in form of a cylinder, and is connected to an inner wall of the external sleeve by an interference fit; one end of the bracket abuts against one end of the atomization base; the circuit board is parallel to an axial direction of the bracket, and is embedded into the bracket; a light transmission hole corresponding to the light transmission portion is defined at one end of a side wall of the bracket that is far away from the atomization base; the lamp body is provided on the circuit board and is oriented towards the light transmission portion.

In another aspect, an electronic cigarette is provided, comprising a electronic cigarette body, wherein, the electronic cigarette body includes a atomization assembly configured for atomizing tobacco tar, a battery assembly configured for supplying power to the atomization assembly, an airflow sensing assembly configured for sensing a smoking action, and a control module configured for controlling the battery assembly to supply power to the atomization assembly based on a smoking signal sent by the airflow sensing assembly;

a receiving space is formed between the atomization assembly and the battery assembly; wherein the receiving space and an outer peripheral face of the electronic cigarette body that corresponds to the receiving space are isolated from each other, in such a way that air in the receiving space is isolated from air outside the outer peripheral face of the electronic cigarette body that corresponds to the receiving space; a lamp assembly is received in the receiving space; wherein the lamp assembly is electrically connected to the battery assembly and configured to emit light when the electronic cigarette is at work; a light transmission portion is provided on a side wall of the electronic cigarette body that corresponds to the receiving space, and is configured to transmit lights emitted from the lamp assembly to the outside of the electronic cigarette body;

an inlet channel configured for airflow to flow in and a smoke channel configured for smoke produced by the atomization assembly to flow out are defined in the electronic cigarette body; the receiving space is communicated with the inlet channel and the smoke channel respectively, in such a way that an airflow outside the electronic cigarette is capable of entering the inlet channel, and further entering the smoke channel after passing through the receiving space;

the electronic cigarette body further includes an atomization base; the atomization assembly includes a fixing pipe fixed on the atomization base, a tobacco tar storing element coated on the fixing pipe and configured for storing the tobacco tar, and a heating wire assembly configured for atomizing the tobacco tar; wherein the smoke channel is formed in the fixing pipe; the heating wire assembly is received in the smoke channel and is fixed on the fixing pipe;

at least one end of the atomization assembly is received in the receiving space and corresponds to the light transmission portion; the atomization base is an elastic light guide element, and is configured to guide the light emitted from the lamp assembly to the light transmission portion; a marker layer is provided on the outer surface of the electronic cigarette body that corresponds to the light transmission portion;

the electronic cigarette further includes a smoking end; the electronic cigarette body further includes an external sleeve; the atomization assembly, the battery assembly and the lamp assembly are all received in the external sleeve; the smoking end is connected to one end of the external sleeve that is far away from the battery assembly; the airflow sensing assembly is provided at one end of an inner side of the external sleeve that is far away from the atomization assembly;

the lamp assembly includes a lamp body, a circuit board and a bracket; the bracket is in form of a cylinder, and is connected to an inner wall of the external sleeve by an interference fit; one end of the bracket abuts against one end of the atomization base; the circuit board is perpendicular to the axial direction of the atomization base, and is engaged with the bracket; the lamp body is mounted on one surface of the circuit board that is facing towards the atomization base.

When implementing the electronic cigarette of the present application, the following advantageous effects can be achieved:

by providing the lamp assembly and the light transmission portion between the atomization assembly and the battery assembly, the light emitted from the lamp assembly may exit the electronic cigarette through the light transmission portion for indication, so that smokers may get clear warning signs, and avoid from gripping the region having the atomization assembly provided on with fingers. Thereby, the defect in the prior art that, the heat emitted from the atomization assembly at work may scald the fingers or make the users feel uncomfortable since the users are used to gripping the region having the atomization assembly provided on with fingers, can be solved. Secondly, in this case, the receiving space and the outer peripheral face of the electronic cigarette body that corresponds to the receiving space are isolated from each other, and the electronic cigarette is controlled by the cooperation of the airflow sensing assembly and the controller. And thus, the defect in prior art that, the external air may enter into the atomization assembly as will and cause the tobacco tar to be oxidized since a key switch is used to control the electronic cigarette, can be solved. Besides, the airflow sensing assembly may be avoided from being triggered spuriously. Thirdly, when using the electronic cigarette, if a high-powered lamp assembly is contained in the electronic cigarette, the heat generated by the lamp assembly may be used to stove the tobacco tar leaked from the atomization assembly to the battery assembly. In this way, the short-out of the batter assembly due to the tobacco tar leaked out may be prevented from occurring. Besides, the tobacco tar leaked out may be volatilized by heating of the lamp assembly in time, and thus peculiar smell may be prevented from being produced since the tobacco tar leaked out is prevented from being oxidized, and the smokers will not suck in the air with peculiar smell. Besides, by using lamp assembly to stove the tobacco tar, particularly, when using the heating element such as a bare heating piece or a heating wire or the like for heating, short-out and current leakage may be avoided. Therefore, the electronic cigarette is reliable and safe, and user experience can be improved.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

Figure 1:
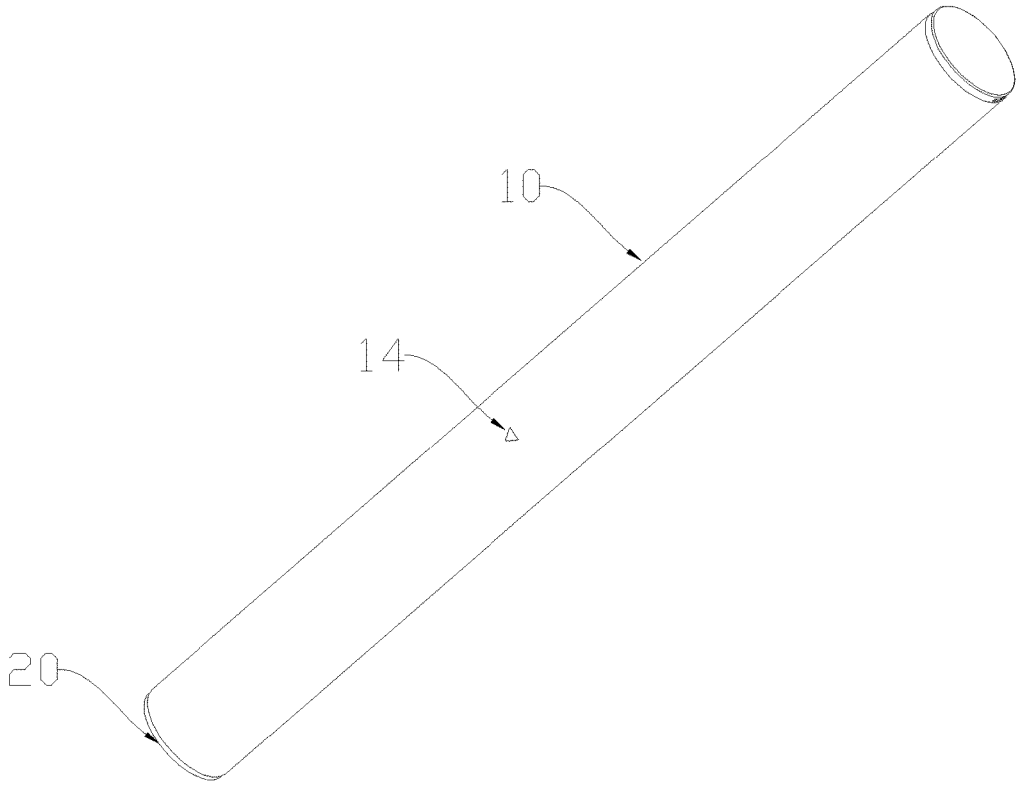
FIG. 1 is a whole structural schematic view of an electronic cigarette according to a first embodiment of the present application.
Figure 2:
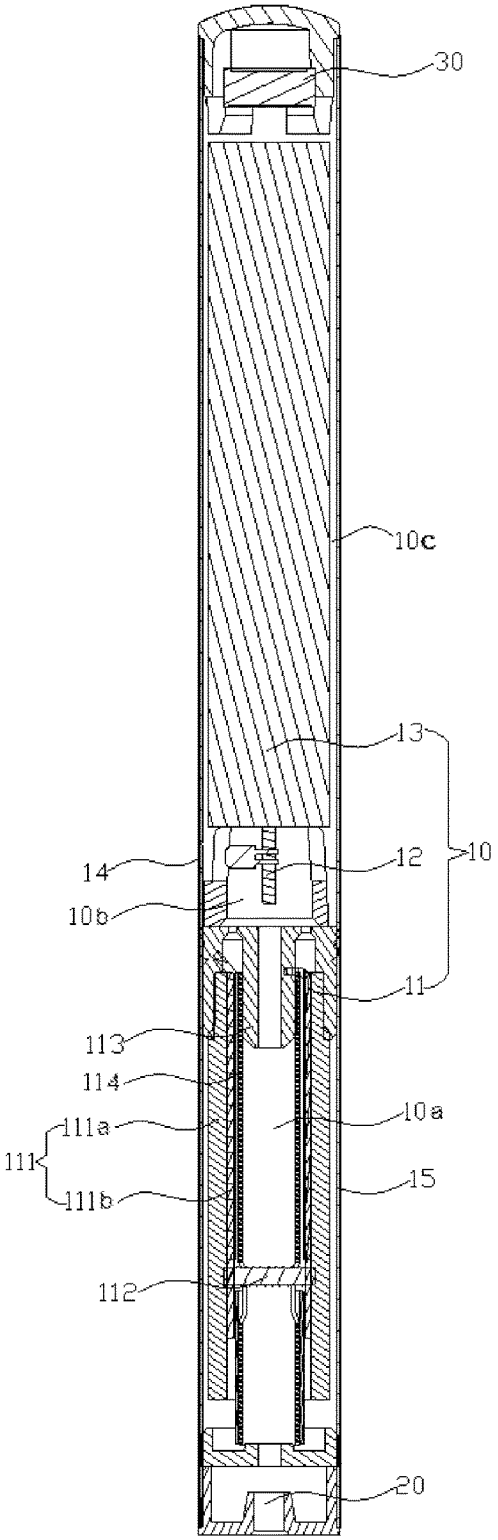
FIG. 2 is a cutaway structure view of the electronic cigarette shown in FIG. 1.

Referring to FIG. 1, an electronic cigarette according to a first embodiment of the present application is shown. Referring to FIGS. 1-2, an electronic cigarette comprises an electronic cigarette body 10 and a smoking end 20 provided on the electronic cigarette body 10. Wherein the electronic cigarette body 10 includes an atomization assembly 11 configured for atomizing tobacco tar, a lamp assembly 12, a battery assembly 13 configured for supplying power to the atomization assembly 11 and the lamp assembly 12, an airflow sensing assembly 30 configured for sensing a smoking action and a control module (not shown). The control module is configured to control the battery assembly 13 to supply power to the atomization assembly 11 based on a smoking signal sent by the airflow sensing assembly 30.

A receiving space 10*b* is formed between the atomization assembly 11 and the battery assembly 13, wherein the receiving space 10*b* and an outer peripheral face of the electronic cigarette body 10 that corresponds to the receiving space 10*b* are isolated from each other. The lamp assembly 12 is received in the receiving space 10*b*. A light transmission portion 14 is provided on a side wall of the electronic cigarette body 10 that corresponds to the receiving space 10*b*, and is configured to transmit lights emitted from the lamp assembly 12 to the outside of the electronic cigarette body 10. In present embodiment, the smoking end 20 is a suction nozzle cover. Of course, the smoking end 20 may be an independent suction nozzle or a component without the suction nozzle cover, and the structure of the smoking end is not limited here.

Providing the lamp assembly 12 and the light transmission portion 14 that corresponds to the lamp assembly 12 between the atomization assembly 11 and the battery assembly 13, the light emitted from the lamp assembly 12 may exit the electronic cigarette through the light transmission portion 14 for indication, so that smokers may get clear warning signs, and avoid from gripping the region having the atomization assembly provided on with fingers. Thereby, the defect in the prior art that, the heat emitted from the atomization assembly 11 at work may scald the fingers or make the users feel uncomfortable since the users are used to gripping the region having the atomization assembly provided on with fingers, can be solved. Secondly, in this case, the receiving space 10*b* and the outer peripheral face of the electronic cigarette body 10 that corresponds to the receiving space 10*b* are isolated from each other, and the electronic cigarette is controlled by the cooperation of the airflow sensing assembly 30 and the controller. And thus, the defect in prior art that, the external air may enter into the atomization assembly 11 as will and cause the tobacco tar to be oxidized since a key switch is used to control the electronic cigarette, can be solved. Besides, the airflow sensing assembly may be avoided from being triggered spuriously. Thirdly, when using the electronic cigarette, if a high-powered lamp assembly 12 is contained in the electronic cigarette, the heat generated by the lamp assembly 12 may be used to stove the tobacco tar leaked from the atomization assembly 11 to the battery assembly 13. In this way, the short-out of the batter assembly 13 due to the tobacco tar leaked out may be prevented from occurring. Besides, the tobacco tar leaked out may be volatilized by heating of the lamp assembly 12 in time, and thus peculiar smell may be prevented from being produced since the tobacco tar leaked out is prevented from being oxidized, and the smokers will not suck in the air with peculiar smell. Besides, by using lamp assembly 12 to stove the tobacco tar, particularly, when using the heating element such as a bare heating piece or a heating wire or the like for heating, short-out and current leakage may be avoided. Therefore, the electronic cigarette is reliable and safe, and user experience can be improved.

In addition, the electronic cigarette body 10 includes an inlet channel 10*c* configured for airflow to flow in, and a smoke channel 10*a* configured for the smoke produced by the atomization assembly 11 to flow out. One end of the smoke channel 10*a* that is far away from the inlet channel inlet channel 10*c* is communicated with the smoking end 20. The receiving space 10*b* is communicated with the inlet channel 10*c* and the other end of the smoke channel 10*a*. It is possible for the inlet channel 10*c* to be formed in a gap between the battery assembly 13 and an outer sleeve 15, or to be directly formed in the battery assembly 13. The position of the inlet channel 10*c* is not limited here.

With the electronic cigarette body and the lamp assembly 12 that may generate heat, cold air entering into the receiving space 10*b* through the inlet channel 10*c* is preheated by the heat emitted from the lamp assembly 12. In this way, the smoke may be prevented from condensing when meeting with air with lower temperature which enters into the smoke channel 10*a*. Besides, the smoke produced by heating the back flowed tobacco tar with the lamp assembly 12 is delivered to the smoke channel 10*a* by the airflow passing the receiving space 10*b*, and thus the tobacco tar may be prevented from accumulating in the receiving space 10*b* or even entering into the battery assembly 13.

In specific, the light transmission portion 14 may be in form of a circle, a triangle or a square. Of course, the shape of the light transmission portion 14 is not limited here. A marker layer is provided on an outer surface of the electronic cigarette body 10 that corresponds to the light transmission portion 14. Characters or pictures may be formed on the marker layer. For example, a trademark of the electronic cigarette or other pictures may be formed on the marker layer. The marker layer is more conspicuous when the lamp assembly 12 is glowing, which is convenient for the users to observe, and the user experience can be improved as a result. The electronic cigarette body 10 further includes an external sleeve 15. The atomization assembly 11, the battery assembly 13 and the lamp assembly 12 are all received in the external sleeve 15. The smoking end 20 is provided on one end of the external sleeve 15 that is far away from the battery assembly 13. Of course, it is possible for the smoking end 20 to be provided on one end of the external sleeve 15 that is far away from the atomization assembly 11. The light transmission portion 14 is provided on the corresponding region of the external sleeve 15.

The external sleeve 15 may be a light transmission element. A tag (not shown) is coated on the outer side wall of the external sleeve 15, and the marker layer is provided on the corresponding region of the tag. Or a coating layer is coated on the outer peripheral face of the external sleeve 15. Preferably, the coating layer is a paint film. The outer side wall of the external sleeve 15 is covered in a film of the coating layer, and the marker layer is provided on the region of the coating layer of the external sleeve 15 that corresponds to the light transmission portion 14. The region of the coating layer outside the marker layer is formed by spraying light-tight coating or the coating with poor transmittance, while the region of the coating layer that corresponds to the marker layer is formed by spraying light transmission coating. Besides, the marker layer may be formed by spraying coating on the corresponding region of the coating layer. When the light emitted from the lamp assembly 12 passes through the light transmission portion 14 and then enters the marker layer, the marker layer will be lit up, and thus it is convenient for the users to recognize the marker layer. As the thickness of the marker layer and the coating layer can be ignored, the user may not feel uneven when touching the electronic cigarette. And thus, the user experience can be improved.

The external sleeve 15 may be made from light-proof materials. The light transmission portion 14 is a light transmission hole defined on the external sleeve 15. A tag (not shown) is coated on the outer side wall of the external sleeve 15, and the marker layer is provided on the region of the tag that corresponds to the light transmission portion 14. The light emitted from the lamp assembly 12 passes through the light transmission portion 14 and then enters the marker layer, in this way, the marker layer is lit up, and thus it is convenient for the users to recognize the marker layer. Preferably, the marker layer is red, and the other region of the outer surface of the tag is black, so that it is convenient to recognize. The tag may be made from PET (Polyethylene terephthalate) or other materials, and it isn't limited here.

The electronic cigarette body 10 further includes an atomization base 113. The atomization assembly 11 includes a fixing pipe 114 fixed on the atomization base 113, a tobacco tar storing element 111 coated on the fixing pipe 114 and configured to store tobacco tar, and a heating wire assembly 112 fixed on the fixing pipe 114 and configured to atomize the tobacco tar. The smoke channel 10*a* is formed in the fixing pipe 114. The atomization base 113 is made from elastic material, and is configured to fix the fixing pipe 114, to defend the vibration, and to prevent the tobacco tar from returning back to the receiving space 10*b*. The tobacco tar storing element 111 includes an oil cotton 111*a* configured to store the tobacco tar and a non-woven fabric 111*b* configured to guide the tobacco tar. The non-woven fabric 111*b* is coated on the fixing pipe 114, and the oil cotton 111*a* is coated on the non-woven fabrics 111*b*. Of course, other structures can be used for the atomization assembly 11. For example, the heating wire assembly 112 may be replaced by an ultrasonic atomization device. In other cases, the tobacco tar storing element 111 may be replaced by an oil cup for storing tobacco tar. The structure of the atomization assembly 11 isn't limited here.

The battery assembly 13 includes a battery and a battery sleeve. The battery assembly 13 is capable of supplying power and is available in the prior art. The battery assembly 13 isn't limited here. The airflow sensing assembly 30 is received in one end of an inner side of the external sleeve 15 that is far away from the smoking end 20. When smoking, the airflow sensing assembly 30 senses the airflow inhaled in the inlet channel 10*c*, and sends a smoking signal to the control module when it senses the airflow. The control module then controls the battery assembly 13 to supply power to the atomization assembly 11 and the lamp assembly 12 based on the smoking signal. Wherein the airflow sensing assembly 30 and the control module are available in the market, and the structures will not be described in detail here.

Figure 3:
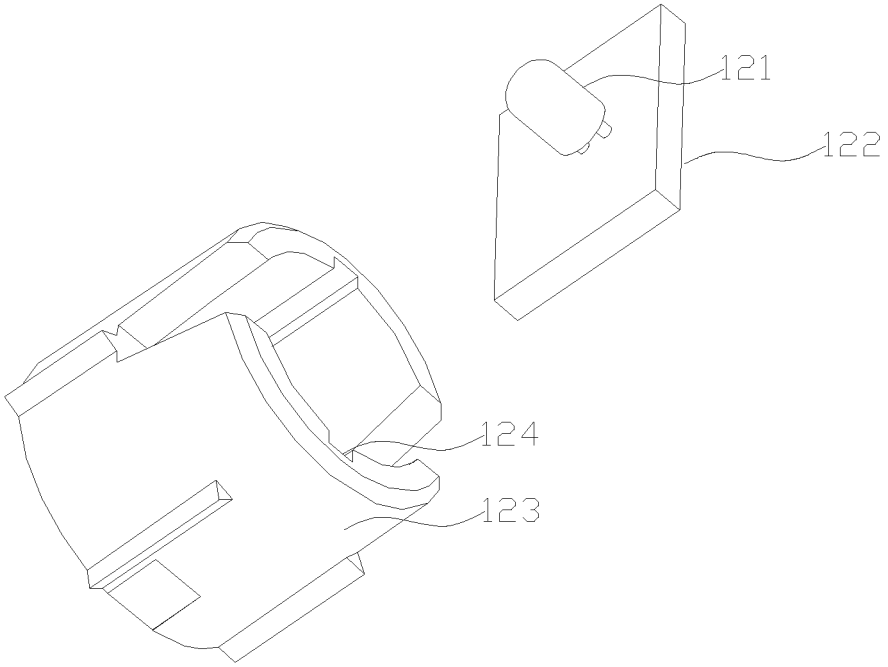
FIG. 3 is an explored view of a lamp assembly shown in FIG. 1.

Referring to FIG. 3, the lamp assembly 12 includes a lamp body 121, a circuit board 122 and a bracket 123. Two notches 124 opposite to each other are defined on the inner side of the bracket 123. The lamp body 121 is mounted on the circuit board 122. Two sides of the circuit board 122 are engaged with the two notches. In this way, the circuit board 122 is embedded into the bracketed. The bracket 123 is embedded into the external sleeve 15 and is further located in the receiving space 10*b* between the battery of the battery assembly 13 and the atomization assembly 11. The bracket 123 is substantially in form of a cylinder, wherein the bracket 123 is connected to an inner wall of the external sleeve 15 by an interference fit. The bracket 123 and the external sleeve 15 are coaxially arranged. One end of the bracket 123 abuts against one end of the atomization base 113. A light transmission opening that corresponds to the light transmission portion 14 is defined at one end of the side wall of the bracket 123 that is far away from the atomization base 113. In the present embodiment, a board surface of the circuit board 122 is parallel to an axial direction of the bracket 123. The lamp body 121 extends along the direction perpendicular to the axial direction of the bracket 123, and further orients towards the light transmission opening and the light transmission portion 14. The lamp body 121 may consist of a LED light. As the LED light emits light stably and can generate more heat, the tobacco tar leaked out may be stoved more effectively. It should be understood that the lamp body 121 may be the lamp body generating plenty of heat. In order to improve the luminance of the indication and the quality of heat, the lamp body 121 may include a plurality of LED lights.

Figure 4:
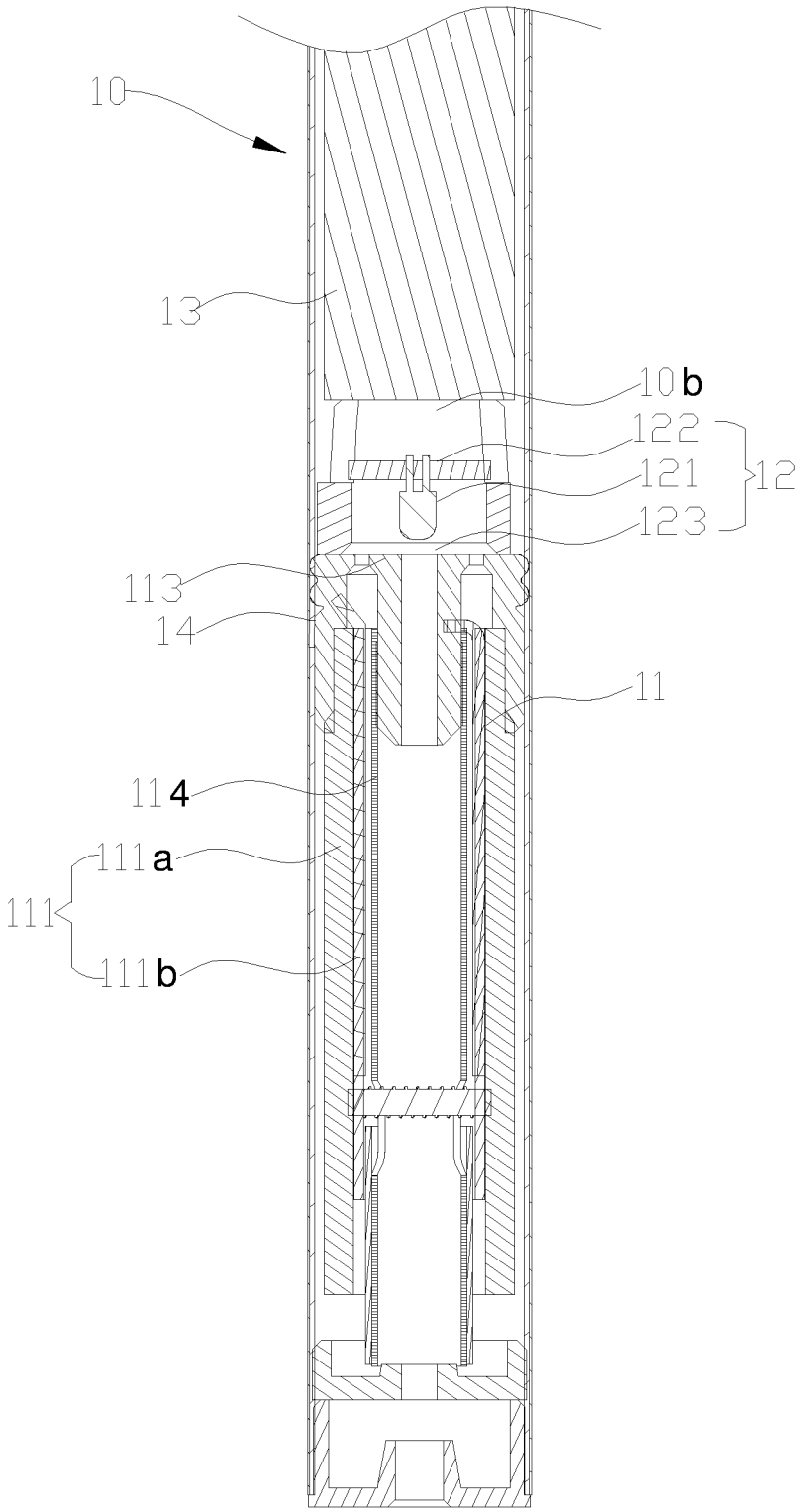
FIG. 4 is partial view of an electronic cigarette according to a second embodiment of the present application.

Referring to FIG. 4, an electronic cigarette according to a second embodiment of the present application is shown. The differences between the electronic cigarette in present embodiment and the electronic cigarette in the first embodiment are as follows: at least one end of the atomization base 113 is received in the receiving space 10*b* and corresponds to the light transmission portion 14, and an end portion of the atomization base 114 abuts against an end portion of the bracket 123. The board surface of the circuit board 122 is perpendicular to the axial direction of the atomization base 113, and is engaged with the bracket 123. The lamp body 121 is mounted on one surface of the circuit board 122 that is facing towards the atomization base 113, and is closed to the atomization base 113. Wherein, the atomization base 113 is an elastic light guide element and is configured to guide the light emitted from the lamp assembly 12 to the light transmission portion 14. Therefore, the atomization base 113 plays a role of guiding light in the present embodiment. The light emitted from the lamp body 121 is guided by the atomization base 113 and enters the light transmission portion 14, the light further enters the marker layer through the light transmission portion 14, and thus the marker layer is lit up. Therefore, light-spots formed by bright light in part of the marker layer may be prevented from occurring. And the users can observe the marker layer without interference. In the present application, the atomization base 113 is made from silicone-rubber. Of course, it can be made from other materials, and it isn't limited here.

Figure 5:
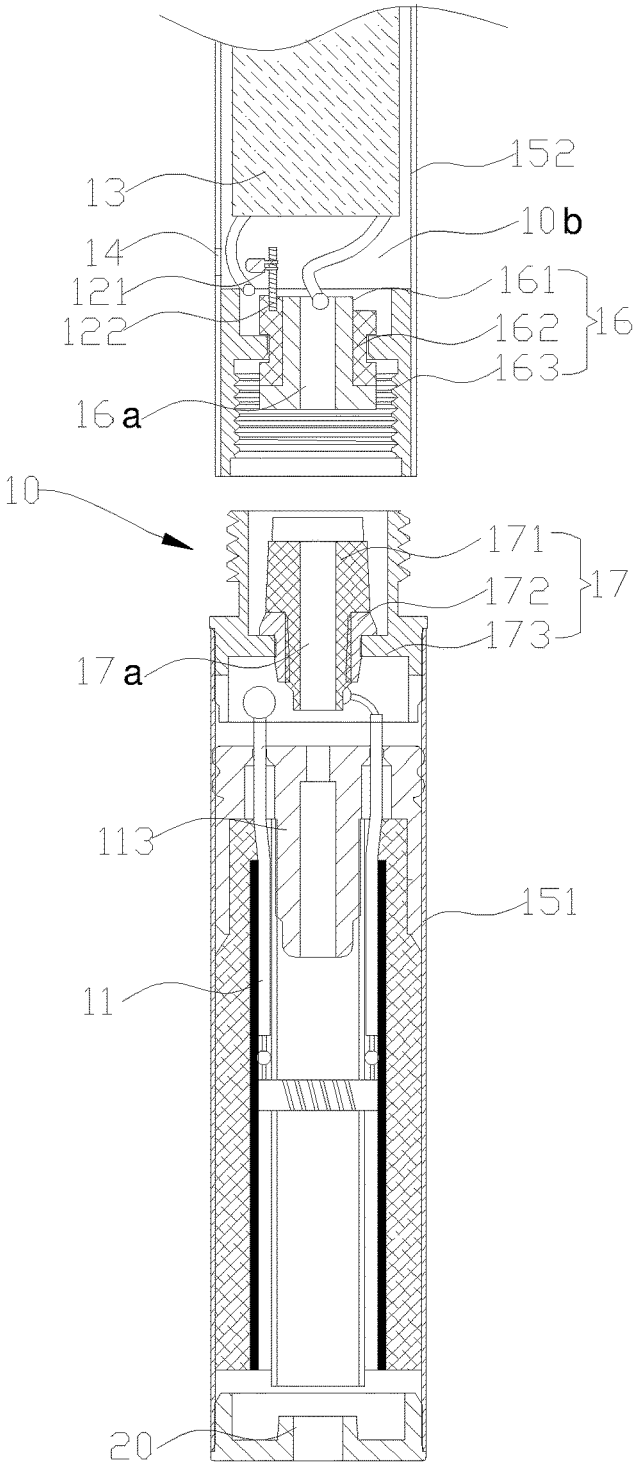
FIG. 5 is a partial view of an electronic cigarette according to a third embodiment of the present application.

Referring to FIG. 5, an electronic cigarette according to a third embodiment of the present application is shown. The differences between the electronic cigarette in present embodiment and the electronic cigarette in the first embodiment are as follows: in present embodiment, the external sleeve 15 includes an atomization sleeve 151 and a battery sleeve 152 which are detachably connected to each other. The battery assembly is received in the battery sleeve 152, and the atomization assembly 11 is received in the atomization sleeve 151. The smoking end 20 is connected to one end of the atomization sleeve 151 that is far away from the battery sleeve 152. The airflow sensing assembly 30 is provided at one end of inner side of the battery sleeve 152 that is far away from the atomization sleeve 151.

A first electrode connecting element 17 is provided at one end of the atomization sleeve 151 that is close to the battery sleeve 152, and the first electrode connecting element 17 is electrically connected to the atomization assembly 11. A second electrode connecting element 16 is provided at one end of the battery sleeve 152 that is close to the atomization sleeve 151, and the second electrode connecting element 16 is electrically connected to the battery assembly 13. The first electrode connecting element 17 and the second electrode connecting element 16 is detachably and electrically connected to each other.

In specific, the first electrode connecting element 17 includes a first internal electrode 171, a first insulating sleeve 172 and a first threaded electrode 173. The first internal electrode 171 is mounted on the inner side of the first threaded electrode 173, and is insulated from the first threaded electrode 173 through the first insulating sleeve 172. The first internal electrode 171 and the first threaded electrode 173 are electrically connected to two ends of the heating wire assembly 112 of the atomization assembly 11 respectively.

The second electrode connecting element 16 includes a second internal electrode 161, a second insulating sleeve 162 and a second threaded electrode 163. The second internal electrode 161 is mounted on the inner side of the second threaded electrode 163, and is insulated from the second threaded electrode 163 through the second insulating sleeve 162. The second internal electrode 161 and the second threaded electrode 163 are electrically connected to two electrodes of the battery of the battery assembly 13 respectively.

In the present embodiment, the receiving space 10*b* is formed between the battery of the external sleeve 15 and the second electrode connecting element 16. The lamp assembly 12 may only include the lamp body 121 and the circuit board 122. The circuit board 122 is inserted in the second insulating sleeve 162 and extends along the direction facing towards the battery. The lamp body 121 is provided perpendicularly on the circuit board and faces towards the light transmission portion 14.

A first through hole 17*a* is defined in the first internal electrode 171 of the first electrode connecting element 17 along an axial direction of the first electrode connecting element. Wherein, the first through hole 17*a* is communicated with the receiving space 10*b*. A second through hole 16*a* is defined in the second internal electrode 161 of the second electrode connecting element 16 along an axial direction of the second internal electrode. In this case, the second through hole 16*a* is communicated with one end of the smoke channel 10*a* that is far away from the smoking end 20. The first through hole 17*a* is communicated with the second through hole 16*a*.

In the present application, on one hand, the lamp assembly 12 has an indication function, so that the smokers can get clear warning signs and avoid griping the region having the atomization assembly provided on with fingers. Thereby, the defect in the prior art that, the heat emitted from the atomization assembly 11 at work may scald the fingers or make the users feel uncomfortable since the users are used to gripping the region having the atomization assembly provided on with fingers, can be solved. On the other hand, when the lamp assembly 12 is working, the heat generated by the heated lamp assembly 12 can be used to stove the tobacco tar leaked from the atomization assembly 11 to the battery assembly 13. In this way, the short-out of the batter assembly 13 due to the tobacco tar leaked out may be prevented from occurring. Besides, the tobacco tar leaked out may be stoved and heated by the lamp assembly 12 in time, and thus peculiar smell may be prevented from being produced since the tobacco tar leaked out is prevented from being oxidized, and the smokers will not suck in the air with peculiar smell.

As the receiving space 10*b* of the lamp assembly 12 is communicated with the inlet channel 10*c* and the smoke channel 10*a*, the cold air entering into the receiving space 10*b* through the inlet channel 10*c* is preheated by the heat emitted from the lamp assembly 12. In this way, the smoke may be prevented from condensing when meeting with air with lower temperature which enters into the smoke channel 10*a*. Besides, the smoke produced by heating the back flowed tobacco tar with the lamp assembly 12 is delivered to the smoke channel 10*a* by the airflow passing the receiving space 10*b*, and thus the tobacco tar may be prevented from accumulating in the receiving space 10*b* or even entering into the battery assembly 13.

While the present application has been described with reference to preferred embodiments, however, the present application is not limited to above-mentioned embodiments, those modifications, improvements and equivalent substitutions, which don't depart from the scope of the spirit and the principle of the present application, should be included within the scope of the present application. For example, the lamp assembly can be a light source with a low power or the like which supplies light as required, should be included within the scope of the present application.

What is claimed is:

1. An electronic cigarette, comprising an electronic cigarette body (10), wherein, the electronic cigarette body (10) includes a atomization assembly (11) configured for atomizing tobacco tar, a battery assembly (13) configured for supplying power to the atomization assembly (11), an airflow sensing assembly (30) configured for sensing a smoking action, and a control module configured for controlling the battery assembly to supply power to the atomization assembly (11) based on a smoking signal sent by the airflow sensing assembly (30);

wherein a receiving space (10*b*) is formed between the atomization assembly (11) and the battery assembly (13); the receiving space (10*b*) and an outer peripheral face of the electronic cigarette body (10) that corresponds to the receiving space (10*b*) are isolated from each other, in such a way that air in the receiving space (10*b*) is isolated from air outside the outer peripheral face of the electronic cigarette body (10) that corresponds to the receiving space (10*b*); a lamp assembly (12) is received in the receiving space, the lamp assembly (12) is electrically connected to the battery assembly (13) and configured to emit light when the electronic cigarette is at work; a light transmission portion (14) is provided on a side wall of the electronic cigarette body (10) that corresponds to the receiving space (10*b*), and is configured to transmit lights emitted from the lamp assembly (12) to the outside of the electronic cigarette body (10); and wherein an inlet channel (10*c*) configured for airflow to flow in and a smoke channel (10*a*) configured for smoke produced by the atomization assembly (11) to flow out are defined in the electronic cigarette body (10); the receiving space (10*b*) is communicated with the inlet channel (10*c*) and the smoke channel (10*a*) respectively, in such a way that an airflow outside the electronic cigarette is capable of entering the inlet channel (10*c*), and further entering the smoke channel (10*a*) after passing through the receiving space (10*b*);

wherein the electronic cigarette body (10) further includes an atomization base (113); the atomization assembly includes a fixing pipe (114) fixed on the atomization base (113), a tobacco tar storing element (111) coated on the fixing pipe (114) and configured for storing the tobacco tar, and a heating wire assembly (112) configured for atomizing the tobacco tar; wherein the smoke channel (10*a*) is formed in the fixing pipe (114); the heating wire assembly (112) is received in the smoke channel (10*a*) and is fixed on the fixing pipe (114);

wherein the light transmission portion (14) is sleeved around the atomization base (113), the atomization base (113) is an elastic light guide element and is configured to guide the light emitted from the lamp assembly (12) to the light transmission portion (14); and wherein the lamp assembly (12) includes a lamp body (121), a circuit board (122) and a bracket (123); the bracket (123) is in form of a cylinder, and is connected to an inner wall of an external sleeve (15) by an interference fit; one end of the bracket (123) abuts against one end of the atomization base (113); the circuit board (122) is perpendicular to axial direction of the atomization base (113), and is engaged with the bracket (123); the lamp body (121) is mounted on one surface of the circuit board (122) that is facing towards the atomization base (113).

2. The electronic cigarette according to claim 1, wherein the light transmission portion (14) is in form of a circle, a triangle or a square.

3. The electronic cigarette according to claim 1, wherein the lamp body (121) is a LED light.

4. The electronic cigarette according to claim 3, wherein a marker layer is provided on the outer surface of the electronic cigarette body (10) that corresponds to the light transmission portion (14).

5. The electronic cigarette according to claim 4, wherein the electronic cigarette body (10) further includes an external sleeve (15); the atomization assembly (11), the battery assembly (13) and the lamp assembly (12) are all received in the external sleeve (15); the light transmission portion (14) is provided on a region of the external sleeve (15) that corresponds to the light transmission portion (14).

6. The electronic cigarette according to claim 5, wherein the electronic cigarette further comprises a smoking end (20) communicated with the smoke channel (10*a*); the smoking end (20) is connected to one end of the external sleeve (15) that is away from the battery assembly (13); the airflow sensing assembly (30) is provided at one end of an inner side of the external sleeve (15) that is away from the atomization assembly (11); the airflow sensing assembly (30) is communicated with the inlet channel (10*c*).

7. The electronic cigarette according to claim 6, wherein the external sleeve (15) is a light transmission element.

8. The electronic cigarette according to claim 6, wherein the light transmission portion (14) is a light transmission hole defined on the region of the external sleeve (15) that corresponds to the light transmission portion (14).

9. The electronic cigarette according to claim 6, wherein, the electronic cigarette body (10) further includes a tag coated on an outer side wall of the external sleeve (15); the marker layer is provided on a region of the tag that corresponds to the light transmission portion (14).

10. The electronic cigarette according to claim 6, wherein a coating layer is coated on an outer side wall of the external sleeve (15), and the marker layer is provided on a region of the coating layer of the external sleeve (15) that corresponds to the light transmission portion (14).

11. An electronic cigarette, comprising an electronic cigarette body (10), wherein the electronic cigarette body (10) includes a atomization assembly (11) configured for atomizing tobacco tar, a battery assembly (13) configured for supplying power to the atomization assembly (11), an airflow sensing assembly (30) configured for sensing a smoking action, and a control module configured for controlling the battery assembly (13) to supply power to the atomization assembly (11) based on a smoking signal sent by the airflow sensing assembly (30);

wherein a receiving space (10*b*) is formed between the atomization assembly (11) and the battery assembly (13); the receiving space (10*b*) and an outer peripheral face of the electronic cigarette body (10) that corresponds to the receiving space (10*b*) are isolated from each other, in such a way that air in the receiving space (10*b*) is isolated from air outside the outer peripheral face of the electronic cigarette body (10) that corresponds to the receiving space (10*b*); a lamp assembly (12) is received in the receiving space (10*b*), the lamp assembly (12) is electrically connected to the battery assembly (13) and configured to emit light when the electronic cigarette is at work; a light transmission portion (14) is provided on a side wall of the electronic cigarette body (10) that corresponds to the receiving space (10*b*), and is configured to transmit lights emitted from the lamp assembly (12) to the outside of the electronic cigarette body (10); an inlet channel (10*c*) configured for airflow to flow in and a smoke channel (10*a*) configured for smoke produced by the atomization assembly (11) to flow out are defined in the electronic cigarette body (10); the receiving space (10*b*) is communicated with the inlet channel (10*c*) and the smoke channel (10*a*) respectively, in such a way that an airflow outside the electronic cigarette is capable of entering the inlet channel (10*c*), and further entering the smoke channel (10*a*) after passing through the receiving space (10*b*);

wherein the electronic cigarette body (10) further includes an atomization base (113); the atomization assembly (11) includes a fixing pipe (114) fixed on the atomization base (113), a tobacco tar storing element (111) coated on the fixing pipe (114) and configured for storing the tobacco tar, and a heating wire assembly (112) configured for atomizing the tobacco tar; wherein the smoke channel (10*a*) is formed in the fixing pipe (114); the heating wire assembly (112) is received in the smoke channel (10*a*) and is fixed on the fixing pipe (114);

wherein the light transmission portion (14) is sleeved around the atomization base (113); the atomization base (113) is an elastic light guide element, and is configured to guide the light emitted from the lamp assembly (12) to the light transmission portion (14); a marker layer is provided on the outer surface of the electronic cigarette body (10) that corresponds to the light transmission portion (14);

wherein the electronic cigarette further includes a smoking end (20); the electronic cigarette body (10) further includes an external sleeve (15); the atomization assembly (11), the battery assembly (13) and the lamp assembly (12) are all received in the external sleeve (15); the smoking end (20) is connected to one end of the external sleeve (15) that is far away from the battery assembly (13); the airflow sensing assembly (30) is provided at one end of an inner side of the external sleeve (15) that is far away from the atomization assembly (11); and wherein the lamp assembly (12) includes a lamp body (121), a circuit board (122) and a bracket (123); the bracket (123) is in form of a cylinder, and is connected to an inner wall of the external sleeve (15) by an interference fit; one end of the bracket (123) abuts against one end of the atomization base (113); the circuit board (122) is perpendicular to the axial direction of the atomization base (113), and is engaged with the bracket (123); the lamp body (121) is mounted on one surface of the circuit board (122) that is facing towards the atomization base (113).

12. An electronic cigarette, comprising an electronic cigarette body (10), wherein, the electronic cigarette body (10) includes a atomization assembly (11) configured for atomizing tobacco tar, a battery assembly (13) configured for supplying power to the atomization assembly (11), an airflow sensing assembly (30) configured for sensing a smoking action, and a control module configured for controlling the battery assembly to supply power to the atomization assembly (11) based on a smoking signal sent by the airflow sensing assembly (30);

wherein a receiving space (10*b*) is formed between the atomization assembly (11) and the battery assembly (13); the receiving space (10*b*) and an outer peripheral face of the electronic cigarette body (10) that corresponds to the receiving space (10*b*) are isolated from each other, in such a way that air in the receiving space (10*b*) is isolated from air outside the outer peripheral face of the electronic cigarette body (10) that corresponds to the receiving space (10*b*); a lamp assembly (12) is received in the receiving space, the lamp assembly (12) is electrically connected to the battery assembly (13) and configured to emit light when the electronic cigarette is at work; a light transmission portion (14) is provided on a side wall of the electronic cigarette body (10) that corresponds to the receiving space (10*b*), and is configured to transmit lights emitted from the lamp assembly (12) to the outside of the electronic cigarette body (10); and wherein an inlet channel (10*c*) configured for airflow to flow in and a smoke channel (10*a*) configured for smoke produced by the atomization assembly (11) to flow out are defined in the electronic cigarette body (10); the receiving space (10*b*) is communicated with the inlet channel (10*c*) and the smoke channel (10*a*) respectively, in such a way that an airflow outside the electronic cigarette is capable of entering the inlet channel (10*c*), and further entering the smoke channel (10*a*) after passing through the receiving space (10*b*);

wherein the electronic cigarette body (10) further includes an atomization base (113); the atomization assembly includes a fixing pipe (114) fixed on the atomization base (113), a tobacco tar storing element (111) coated on the fixing pipe (114) and configured for storing the tobacco tar, and a heating wire assembly (112) configured for atomizing the tobacco tar; wherein the smoke channel (10*a*) is formed in the fixing pipe (114); the heating wire assembly (112) is received in the smoke channel (10*a*) and is fixed on the fixing pipe (114);

wherein the lamp assembly (12) includes a lamp body (121), a circuit board (122) and a bracket (123); the bracket (123) is substantially in form of a cylinder, and is connected to an inner wall of the external sleeve (15) by an interference fit; one end of the bracket (123) abuts against one end of the atomization base (113); the circuit board (122) is parallel to an axial direction of the bracket (123), and is embedded into the bracket (123); a light transmission hole corresponding to the light transmission portion (14) is defined at one end of a side wall of the bracket (123) that is far away from the atomization base (113); the lamp body (121) is provided on the circuit board (122) and is oriented towards the light transmission hole.

* * * * *